United States Patent [19]

Bredeweg

[11] 4,328,386

[45] May 4, 1982

[54] CRUCIBLE ASSEMBLY

[75] Inventor: Roger L. Bredeweg, Stevensville, Mich.

[73] Assignee: Leco Corporation, St. Joseph, Mich.

[21] Appl. No.: 190,358

[22] Filed: Sep. 24, 1980

[51] Int. Cl.[3] ..... H05B 3/00

[52] U.S. Cl. ..... 373/118; 373/122

[58] Field of Search ..... 13/20, 22, 25, 23; 219/427; 73/19

[56] References Cited

U.S. PATENT DOCUMENTS

| | | | |
|---|---|---|---|
| 3,139,474 | 6/1964 | Weech | 13/25 X |
| 3,722,259 | 3/1973 | Kraus | 13/20 X |
| 3,751,965 | 8/1973 | Kraus | 13/20 X |
| 3,812,705 | 5/1974 | Boillot | 73/19 |
| 3,936,587 | 2/1976 | Sitek | 13/23 |
| 3,946,228 | 3/1976 | Biermann | 73/19 X |
| 4,072,814 | 2/1978 | Boillot | 13/20 |

*Primary Examiner*—Roy N. Envall, Jr.

*Attorney, Agent, or Firm*—Price, Heneveld, Huizenga & Cooper

[57] ABSTRACT

A crucible assembly for use in an analytical furnace for the fusion of a sample includes a graphite heating crucible of cylindrical construction having one end open and an enclosed lower end with a positioning member interior to the interior cylindrical wall for receiving and positioning a separate sample holding crucible of cylindrical construction having an open upper end and an enclosed lower end. The heating crucible has an annular upper contact surface for engaging a first electrode and an annular lower contact surface for engaging a second electrode and positions the sample holding crucible in the zone of maximum heat in spaced relationship from the opposite ends of the heating crucible.

17 Claims, 7 Drawing Figures

CRUCIBLE ASSEMBLY

BACKGROUND OF THE INVENTION

The present invention relates to crucibles for the fusion of samples for analysis and particularly to crucibles made of a resistive material.

In resistance furnaces for fusing specimens to obtain gas samples therefrom of the type manufactured by Leco Corporation of St. Joseph, Mich., as an integral part of an analyzer such as a model TC-36, graphite sample-holding crucibles are employed for containing the sample. The crucible is typically positioned between actuating electrodes for applying pulsed current thereto for heating the sample to a fusion temperature in excess of 3000° C. Several crucible designs have previously been employed in such furnaces including crucibles of the type described in U.S. Pat. Nos. 3,636,229, and 3,899,627, both of which are assigned to the assignee of the present invention.

It has been discovered that during fusion of samples in such crucibles, the typically metallic sample tends to diffuse into the graphite sidewalls of the crucible thereby changing its resistive characteristics and accordingly, the temperature at which a crucible will heat a sample as the operating power is applied to it. Although this is not a serious problem when the crucibles are employed for rapidly fusing specimens at a relatively high rate, it adversely affects the temperature characteristics if it is desired to uniformly and gradually heat the crucible in a predictable pattern. Thus, for example, in an analyzer of the type described in copending U.S. application Ser. No. 190,357 Method and Apparatus for Controlling an Analytical Furnace filed concurrently herewith, it is desired to increase the temperature of the fusion furnace in a stepwise fashion which is directly related to the applied power. To achieve this, based upon application of power alone, it is necessary to assure that the graphite crucible maintain a substantially constant resistance as increasing power is applied to achieve the predictable temperature increases.

Multiple piece crucible assemblies have been provided in the prior art. For example, one such crucible design as shown in FIG. 1 of the present application in which two cylindrically shaped crucibles are employed with one telescopically fitting within the other. Such crucible is specifically designed for an analyzer which provides rapid fusion of the sample within the inner crucible with the outer crucible providing the heat of fusion necessary to combust the sample. The specific structure of this crucible however does not render it operationally advantageous for use in the environment of the present invention.

SUMMARY OF THE PRESENT INVENTION

It has been discovered that by providing a two-piece crucible assembly with a first or heating crucible into which a second or sample holding crucible is inserted, resistance and therefore temperature variations suffered by prior art crucibles can be avoided in analyzers in which the power is gradually or predictably applied over a period of time to provide uniform temperature increases. The crucible assembly of the present invention includes a heating crucible comprising a generally cylindrical graphite vessel having an open upper end and an enclosed lower end defining the bottom of the crucible. The heating crucible includes means spaced from the bottom for positioning a sample holding crucible therein. The sample holding crucible comprises a cylindrical member having an open end and an enclosed end and adapted to fit within the heating crucible and engage the positioning means to locate the sample holding crucible in the maximum heating zone of the heating crucible. The present invention includes this assembly as well as its individual components.

In a preferred embodiment of the heating crucible, the bottom includes a centrally located centering button and is chamfered at its lower outer edge and an upper annularly outwardly extending shoulder is provided for reinforcing the cylindrical sidewall of the crucible.

The present invention, its features and advantages can be best understood by reference to the following description thereof together with the drawings in which:

DETAILED DESCRIPTION OF THE PREFERRED EMBODIMENT

Figure 1:
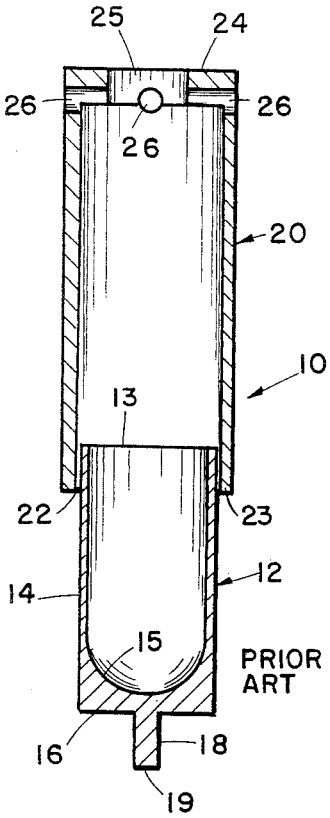
FIG. 1 is a cross sectional view of a prior art crucible assembly.

Referring initially to FIG. 1 there is shown a prior art crucible assembly 10 employed in an analytical furnace of the type which applies an adjustable maximum power level to the crucible assembly for rapidly combusting a specimen. The crucible assembly 10 includes a sample holding crucible 12 comprising a relatively thin walled cylindrical member having an open top 13, a cylindrical sidewall 14, and an enclosed bottom 16. The interior of the bottom is hemispherically rounded at 15 and a rod-shaped standoff 18 extends downwardly from the bottom outer surface of the crucible for holding the sample holding crucible 12 within the cylindrical body of the cylindrically shaped heating crucible 20. The diameter of member 18 is about 0.1 inches.

Crucible 20 has a downwardly extending opening 22 with an internal diameter slightly greater than the external diameter of crucible 12 such that the two crucibles can be telescoped together. The lower surface 23 of heating crucible 20 forms one contact for engagement with an electrode while an upper surface 24 on the semi-enclosed top of the heating crucible defines the remaining electrode contact surface area. An opening 25 extends downwardly through the top of the crucible permitting admission of samples and combustion gas into the sample holding crucible 12. A plurality of radially extending apertures 26 also extends through the top of the crucible permitting gaseous by-products of fusion to escape and subsequently be supplied to an analyzer. The diameter of aperture 25 of crucible 20 is approximately 0.25 inches thereby providing a relatively small hole for the admission of samples into crucible 12 as well as the injection of carrier gases into the furnace in which the crucible assembly is employed. The three radially extending apertures 26 are spaced at 120° and have a diameter of approximately 0.05 inches providing relatively small restrictively sized apertures for the removal of combustion by-products and ones which can relatively easily become clogged by combustion by-products.

In operation, the crucible assembly 10 is placed between a pair of electrodes such that the bottom 19 of standoff 18 holds the outer bottom surface 16 of crucible 12 away from the electrode contact area such with the top edge 13 below the inner top surface of crucible 20 such that the current flow path is between lower surface 23 and upper surface 24 of the heating crucible 20. The construction of the assembly 10 is somewhat fragile in light of the relatively small diameter standoff 18 which is subject to breakage and the utilization of a plurality of apertures 26 and opening 25 in the otherwise enclosed upper end of heating crucible 20. In use, it is necessary to carefully insert crucible 12 within crucible 20 and similarly carefully remove the two-piece construction after an analysis such that breakage does not occur. The complexity of the construction of these crucibles not only render the crucibles very fragile, but it also makes them somewhat costly to construct.

Figure 2:
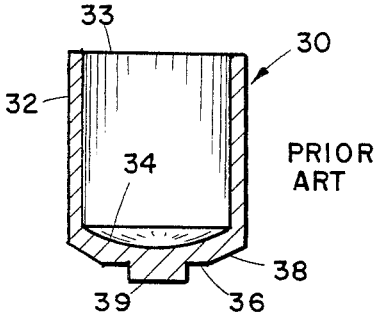
FIG. 2 is a cross sectional view of a piror art crucible.

FIG. 2 shows another prior art crucible 30 which has been employed in resistance heating analytical furnaces for substantially simultaneous combustion of a specimen. The crucible 30 includes a cylindrical sidewall 32 opening at the top at 33 and a concavely rounded interior floor 34. The outer external junction of the bottom 36 with sidewall 32 is chamfered at 38 and a centering button 39 extends downwardly from the central area of the bottom . This crucible is described in greater detail in U.S. Pat. No. 3,899,627 and is commercially available from the assignee of the present invention.

Figure 3:
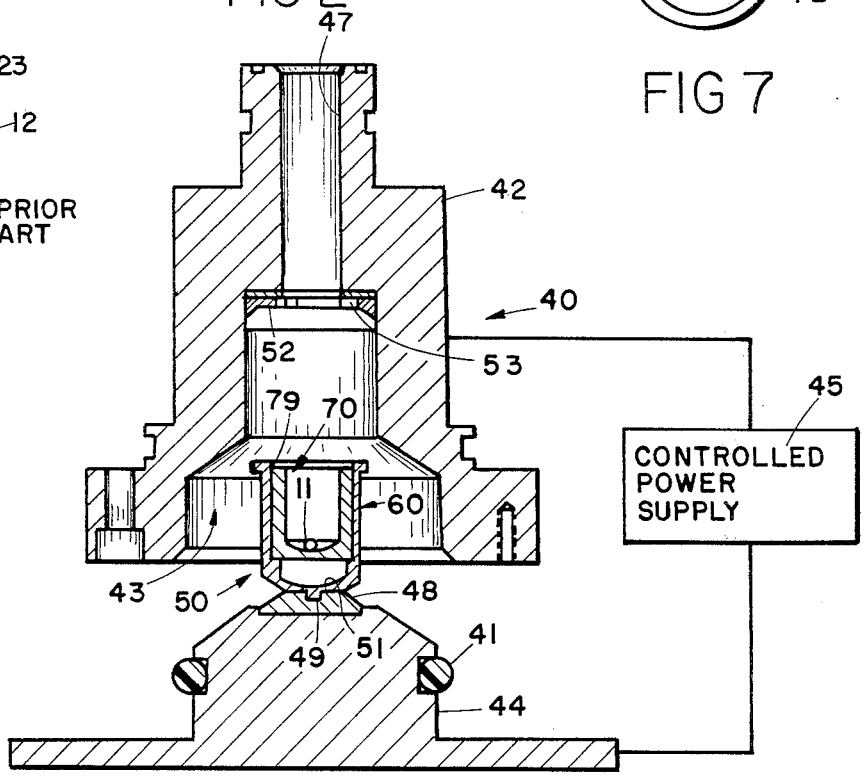
FIG. 3 is a cross sectional view of the crucibles of the present invention and the electrodes used in association therewith.

Referring now to FIG. 3 there is shown an analytical furnace 40 embodying the crucible assembly 50 of the present invention. The furnace includes an upper electrode 42 and a lower electrode 44 between which the crucible assembly 50 is positioned for applying power to the graphite crucible assembly through a controlled power source 45. The crucible assembly 50 includes a heating crucible 60 shown in detail in FIGS. 4 and 6 and a sample holding crucible 70, shown in detail in FIGS. 5 and 7. The furnace is employed for fusing 0.1–2 gram samples such as pin sample 11 shown in FIG. 3. In FIG. 3 the electrodes are shown in an open position with the understanding that the lower electrode is raised to fit within the configurated cylindrical opening 43 of the upper electrode with an O-ring seal 41 sealably engaging the inner cylindrical wall of the upper electrode for sealing the two electrodes together to define a sealed fusion chamber containing crucible assembly 50. The lower electrode 44 includes a pedestal having a tungsten alloy tip 48 with an aperture 49 for receiving the centering button 69' of heating crucible 60. Insert 48 also is tapered to provide an annular contact surface 51 for engaging the annular contact surface 68 of the heating crucible providing an electrical contact therewith. The upper electrode 42 includes a tungsten alloy insert 52 with a plurality of slots 53 communicating with a conduit (not shown) leading through upper electrode 42 to an analyzer similar in construction to that disclosed in U.S. patent application Ser. No. 95,508 entitled Method and Apparatus for Gas Dosing for Linearization, filed Nov. 16, 1979, and assigned to the present assignee, the disclosure of which is incorporated herein by reference.

The analyzer includes an infrared cell for the measurement of carbon dioxide content in the specimen gas which provides a direct indication of the amount of oxygen which is converted to carbon dioxide by the furnace during each combustion cycle. Electrode contact 52 provides a segmented annular contact surface for engaging the upper annular contact surface 66 of heating crucible 60. Power is applied to the crucible assembly 50 to provide a stepwise increased temperature between ambient and slightly in excess of 3000° C. for fusing samples by the controlled power supply 45 which is described in detail in co-pending U.S. patent application entitled Method and Apparatus for Controlling an Analytical Furnace, filed concurrently herewith, assigned to the present assignee, and incorporated herein by reference. The crucible assembly 50 which provides the desired uniform heating characteristics for samples fused in the stepwise increasing fashion to provide separated gas concentrations for oxygen or other specimen gas containing compounds of a sample is described now in detail in connection with FIGS. 4–7.

Figure 4:
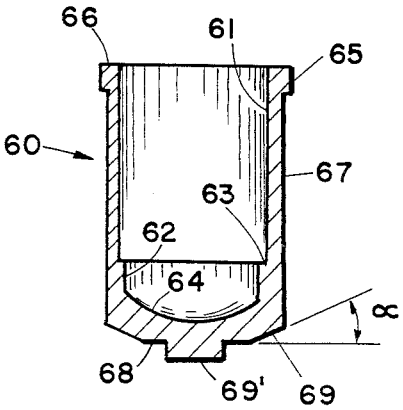
FIG. 4 is an enlarged cross sectional view of the heating crucible of the present invention.
Figure 6:
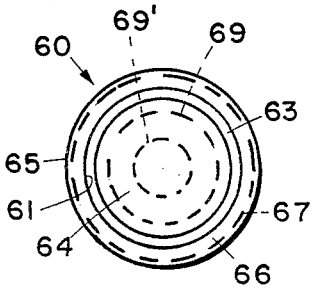
FIG. 6 is a top plan view of the crucible shown in FIG. 4.

Referring initially to FIGS. 4 and 6, the heating crucible 60 is shown which is machined from a solid rod of a resistance heating material such as graphite. In the preferred embodiment the graphite was type 710GL commercially available from Airco Speer. The rod is machined to provide a downwardly projecting cylindrical opening 61 having, in the preferred embodiment, a diameter of approximately 0.508 inches. The cylindrical opening 61 has a reduced diameter at the lower end of the crucible to provide a second downwardly projecting cylindrical opening 62. At the intersections of the cylindrical interior walls defining openings 61 and 62 there is formed a generally horizontally extending annular surface 63 facing upwardly. The diameter of cylindrical projection 62 is approximately 0.485 inches such that annular surface 63 has a width of approximately 0.010 inches.

The interior floor 64 of crucible 60 is concavely rounded with a radius of approximately 0.31 inches. Integrally formed and extending around the upper edge at the top of crucible 60 is an annular shoulder 65 providing reinforcement for the top of the crucible and for defining an annular contact surface 66 at the top of the heating crucible for engaging electrode contact 52 of the furnace. The exterior bottom of the crucible at the junction of sidewall 67 and the bottom 68 is chamfered as shown at 69 at an angle $\alpha$ of approximately 30° in the preferred embodiment. Projecting downwardly from the center of bottom 68 is a solid circular projector 69' defining a centering button which fits within aperture 49 (FIG. 3) of the electrode tip 48. Annular surface 68 thus defines a lower contact surface between the heating crucible and lower electrode while annular contact surface 66 having an outer diameter of approximately 0.625 inches in the preferred embodiment provides the electrical contact with the upper electrode 42. The overall length of crucible 60 between these contact surfaces is approximately 0.9 inches in the preferred embodiment while the inner diameter of annular surface 68 is approximately 0.187 inches while its outer diameter is approximately 0.32 inches. The wall thickness between the chamfered surface 69 and the floor 64 of the crucible is approximately 0.1 inches while the wall thickness of sidewall 67 was approximately 0.038 inches. The zone of maximum heat within the heating crucible 60 comprises the longitudinal portion of the crucible between the lower edge of shoulder 65 and the annular support surface 63. In the preferred embodiment button 69' had a length of approximately 0.055 inches. Heating crucible 60 thereby defines a generally vertically extending crucible having a downwardly projecting concave opening for receiving a sample holding crucible with positioning means comprising the annular shoulder 63 for supporting and centering the sample holding crucible in the maximum heat zone as shown in FIG. 3. The crucible is chamfered to reduce its cross sectional dimension as compared to the overall diameter of the crucible and an upper annular contact surface having an area greater than the annular sidewall area of section 67 of the crucible.

Figure 7:
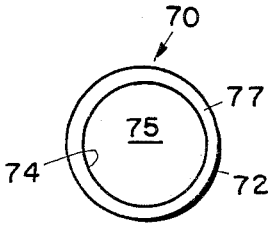
FIG. 7 is a top plan view of the crucible shown in FIG. 5.
Figure 5:
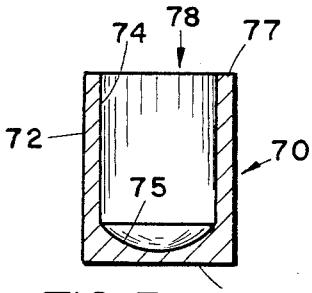
FIG. 5 is an enlarged cross sectional view of the sample holding crucible of the present invention.

The sample holding crucible 70 is shown in FIGS. 5 and 7 and is also machined from a solid graphite rod to include a cylindrical sidewall 72 with a downwardly projecting cylindrical opening 74 terminating in a concavely rounded floor 75 with a radius of curvature of 0.31 inches in the preferred embodiment. The outer diameter of cylindrical wall 72 is approximately 0.5 inches thereby providing 0.008 inches spacing between the external cylindrical wall 72 of sample holding crucible 70 and the internal cylindrical wall 61 of the heating crucible 60. The exterior floor of crucible 70 is flat thereby providing a disc surface the exterior edges of which engage the annular contact surface 63 of the heating crucible 60. The interior diameter of cylindrical wall 74 is approximately 0.4 inches while the overall length between the upper annular surface 77 and the disc-shaped floor 76 is approximately 0.625 inches. With the edge of surface 76 engaging annular surface 63 of the heating crucible, edge 77 will be slightly below (about 0.005 inches) the upper annular electrode contact surface 66 of the heating crucible as shown by gap 79 in FIG. 3. Thus, no electrical contact is made between crucible 70 and the upper electrode 42. The thickness of floor 75 at its minimum thickness is about 0.06 inches and only 0.01 inches thicker than sidewall 72.

Crucible 70 cooperates with crucible 60 to form an integral assembly each crucible of which provide concavely projecting openings extending downwardly from concentric open tops such that a sample can be dropped into the open mouth 78 of crucible 70 through the cylindrical aperture 47 of the upper electrode. Mouth 78 provides a relatively large diameter opening permitting free access to the sample holding crucible for the admission of a sample and also providing a maximum opening for the admission of a carrier gas and the removal of combustion gases.

In operation, the sample holding crucible 70 is fitted within the heating crucible 60 and the assembly 50 is then positioned on the lower electrode 44 as shown in FIG. 3. Lower electrode 44 is then raised into the recess 43 of upper electrode 42 by utilization of a conventional control cylinder means until the upper annular surface 66 of crucible 60 engages contact 52 of the upper electrode. In this position the furnace chamber is sealed by O-ring 41 to provide a sealed combustion chamber. The relatively large diameter open mouth provided by the upperwardly opening concave interior of both heating crucible 60 and sample holding crucible 70 permits the easy admission of a sample through aperture 47 of the upper electrode as well as carrier gas therethrough. Similarly, the gap 79 (FIG. 3) between the upper surface 77 of crucible 70 and the upper surface 66 of crucible 60 permits the by-products of fusion to easily exit the crucible assembly during fusion for transmission to the analyzer through slots 53 in upper electrode contact 52.

After an analysis is completed, electrode 44 is lowered and the crucible assembly 50 removed from the pedestal. The disposable heating crucible 70 can simply be removed from heating crucible 60 by inverting it over a refuse container. Thus, the sample holding crucible 70 can be relatively easily discarded and the rugged heating crucible 60 used about 25–50 times. Such construction provides a less expensive operation then the prior art systems inasmuch as the sample holding crucible 70 is of relatively simplified construction and thereby less costly then the disposable crucible 12 shown in FIG. 1 or that shown FIG. 2 of the prior art. The relatively durably constructed heating crucible 60 is capable of operating for a significant number of analysis and is not particularly fragile nor does it restrict the admission of samples nor the removal of specimen gases from the crucible assembly. The thinnest wall section of crucible 60 provides the zone of maximum heat and is the area in which the sample holding crucible is positioned.

Thus with the system of the present invention a crucible assembly including a heating crucible for supporting in predetermined relationship a sample holding crucible is provided for a resistance heating analytical furnace. In the preferred embodiment of the invention the furnace is of the type which controllably raises the temperature in a stepwise fashion to provide temperature plateaus in which the gaseous contents of different compounds can be separated.

It will become apparent to those skilled in the art that various modifications to the preferred embodiment of the invention as described and disclosed herein can be made by those skilled in the art without departing from the spirit or scope of the invention as defined by the appended claims.

The embodiments of the invention in which an exclusive property or privilege is claimed are defined as follows.

1. A crucible assembly for use in an analytical furnace for the fusion of a sample comprising:

a resistance heating crucible comprising a generally cylindrical member open at an upper end for receiving a sample holding crucible, said heating crucible having an upper annular contact surface at said open end for engaging a first electrode and a lower annular contact surface at its opposite and enclosed lower end for engaging a second electrode such that electrical current can be passed through said crucible between said ends, said heating crucible further including positioning means within said heating crucible for positioning a sample holding crucible within said heating crucible in spaced relationship between said upper and lower ends; and a sample holding crucible of generally cylindrical construction having an upper end and an enclosed lower end, said sample holding crucible cooperating with said positioning means to locate said sample holding crucible when inserted in said heating crucible with said lower end of said sample holding crucible adjacent and spaced from said lower end of said heating crucible and said open upper end of said sample holding crucible spaced from said upper annular contact surface of said heating crucible.

2. The crucible assembly as defined in claim 1 wherein said positioning means comprises an interior annular support surface integrally formed within said heating crucible by providing a cylindrical wall section of reduced diameter near the lower end of said heating crucible.

3. The crucible assembly as defined in claim 2 wherein said heating crucible is chamfered at the junction of its bottom and exterior sidewall and includes a centrally located button-like rod-shaped projection extending downwardly from its bottom to define said lower annular contact surface between said projection and said chamfer.

4. The crucible assembly as defined in claim 3 wherein the interior floor of said heating crucible is concavely rounded.

5. The crucible assembly as defined in claim 4 wherein the interior floor of said sample holding crucible is concavely rounded.

6. The crucible assembly as defined in claim 5 wherein said upper annular contact surface of said heating crucible is defined by an outwardly extending annular shoulder integrally formed at the upper edge of said heating crucible.

7. The crucible assembly as defined in claim 6 wherein said heating crucible has a length of about 0.9 inches between said upper and lower annular contact surfaces and wherein said sample holding crucible has an overall length of about 0.63 inches.

8. Th crucible assembly as defined in claim 7 wherein the internal diameter of said heating crucible is about 0.5 inches in diameter and the reduced diameter wall section is about 0.020 inches smaller.

9. The crucible assembly as defined in claim 8 wherein said chamfer is about 30°.

10. The crucible assembly as defined in claim 9 wherein said heating and sample holding crucibles are made of graphite.

11. A heating crucible for use in holding a separate sample holding crucible in connection with an analytical furnace for the fusion of samples comprising:

a generally cylindrical graphite body having an open upper end and an enclosed lower end, said upper end having an annular shoulder defining an upper annular contact surface, said body including a cylindrical interior wall with a reduced diameter longitudinal section near its enclosed end to define an interior annular support surface, said body further including a concavely rounded floor at its enclosed end and a chamfer at the junction of its exterior cylindrical wall and the bottom, said body further including a downwardly extending centered projection extending from the exterior of its bottom with said annular lower contact surface extending between said projection and said chamfer, wherein said annular support surface positions a sample holding crucible in spaced relationship between the upper and lower ends of said crucible.

12. The crucible as defined in claim 11 wherein said chamfer is about 30°.

13. The crucible as defined in claim 12 wherein said distance between said annular contact surfaces is about 0.9 inches.

14. The crucible as defined in claim 13 wherein the internal diameter of said crucible is about 0.5 inches.

15. For use in an analytical furnace used in fusing samples for analysis and in cooperation with a heating crucible having a cylindrical interior wall with an interior annular support surface spaced from its floor, a sample holding crucible comprising:

a graphite cylindrical body with an open upper end and an enclosed lower end and having a concavely rounded floor for supporting a sample, said enclosed end having a flat disc-shaped exterior bottom with a minimum thickness slightly greater than the wall thickness of said crucible, and wherein the diameter of said sample holding crucible is selected such that the outer edge of said disc-shaped bottom is supported on the annular support surface of the heating crucible when inserted therein.

16. The crucible as defined in claim 15 wherein said crucible has an external diameter of about 0.5 inches, an internal diameter of about 0.4 inches.

17. The crucible as defined in claim 16 wherein said crucible has a length of about 0.6 inches.

* * * * *

UNITED STATES PATENT AND TRADEMARK OFFICE

CERTIFICATE OF CORRECTION

PATENT NO. : 4,328,386

DATED : May 4, 1982

INVENTOR(S) : Roger L. Bredeweg

It is certified that error appears in the above—identified patent and that said Letters Patent is hereby corrected as shown below:

Column 2, line 22

"piror" should be --prior--

Column 5, line 61

"upperwardly" should be --upwardly--

Column 6, line 11

"then" should be --than--

Column 6, line 15 before "Fig. 2" insert --in--

Column 7, line 30

"Th" should be --The--

Signed and Sealed this

*Twentieth* Day of *July 1982*

[SEAL]

*Attest:*

GERALD J. MOSSINGHOFF

*Attesting Officer*

*Commissioner of Patents and Trademarks*